United States Patent [19]

Arad et al.

[11] Patent Number: 4,907,804

[45] Date of Patent: Mar. 13, 1990

[54] POCKET SIZED TOY GAME

[75] Inventors: Abraham Arad, Westport, Conn.; Melvin Kennedy, Hampton Bays, N.Y.

[73] Assignee: Tiger Electronics, Inc., Vernon Hills, Ill.

[21] Appl. No.: 300,272

[22] Filed: Jan. 23, 1989

[51] Int. Cl.[4] ..... A63F 7/06

[52] U.S. Cl. ..... 273/93 R; 273/145 CA; 273/285; 116/223; 206/315.1; 220/82 R

[58] Field of Search ..... 273/285, 88, 93 R, 94, 273/145 R, 145 C, 145 CA, 148 R, 145 A, 145 B, 145 D; 116/222–225; 206/315.1; 220/20, 334, 82 R

[56] References Cited

U.S. PATENT DOCUMENTS

| | | | |
|---|---|---|---|
| 178,537 | 6/1876 | MacIntire | 273/145 D |
| 346,453 | 8/1886 | Baldwin | 273/145 D |
| 1,077,747 | 11/1913 | Phillips | 273/145 D |
| 1,353,380 | 9/1920 | Church | 273/145 D |
| 2,505,382 | 4/1950 | Bridges | 116/223 |
| 2,548,606 | 4/1951 | Huffaker | 273/285 |
| 2,577,087 | 12/1951 | Meeks | 273/145 D |
| 2,636,741 | 4/1953 | Benkoe | 273/145 CA |
| 2,724,595 | 11/1955 | Amann | 273/145 A |
| 4,202,545 | 5/1980 | Watanabe | 273/87 R X |
| 4,209,085 | 6/1980 | Kozan | 206/315.1 X |
| 4,277,067 | 7/1981 | Gettleman | 273/285 |

FOREIGN PATENT DOCUMENTS

| | | | |
|---|---|---|---|
| 503955 | 4/1939 | United Kingdom | 273/285 |
| 1159537 | 7/1969 | United Kingdom | 273/145 CA |

*Primary Examiner*—Edward M. Coven
*Assistant Examiner*—Sebastiano Passaniti
*Attorney, Agent, or Firm*—Dressler, Goldsmith, Shore, Sutker & Milnamow, Ltd.

[57] ABSTRACT

A pocket sized toy game including an enclosure defining a chamber wherein a die is retained for movement, a manually operated mechanism for randomly moving the dice within the chamber, and a game board. The enclosure includes a cover and a pivotally interconnected base. An open sided transparent housing located in a cavity defined by the cover defines a chamber wherein the dice are movably retained. The manually operated mechanism is arranged within the cover and includes a pivotal lever which impacts against the dice to facilitate moving the dice within the chamber to facilitate playing the game. The cover is movable between open and closed positions. In its open position, the cover is generally disposed upright relative to the base. In its closed position, the cover lies generally paralleled to the base and defines a cavity therebetween. The game board is pivotally connected to the cover or base and includes a series of interconnected board segments which are foldable relative to each other to facilitate storage of the game board within the cavity defined between the cover and base. The cover of the present invention further defines a chamber wherein associated markers for playing the game are stored. A door closes this chamber to prevent inadvertent loss of such associated markers. The game of the present invention further includes a scoring apparatus for tracking a player's score.

14 Claims, 4 Drawing Sheets

POCKET SIZED TOY GAME

FIELD OF THE INVENTION

The present invention generally relates to toy games and, more particularly, to a pocket sized toy game including a self-contained game board.

BACKGROUND OF THE INVENTION

A variety of toy games have a game board and a plurality of individual game pieces including dice and several markers for playing the game. The game board, dice, and markers are typically enclosed for storage and transportation in a box-like container.

To promote play, a game should be easily transported and allow quick and easy set up of the game board and game pieces. Most board games are relatively large and, therefore, do not readily lend themselves to travel. Moreover, and primarily because of their size, such board games are usually stored in out-of-the way places and are not readily accessible to children or others interested in playing the game.

Another known problem with board games is that the game pieces, because of their individuality and relatively small size, easily become separated from the game and are often lost. Without dice or the appropriate number of markers, some games cannot be properly played. As such, the game remains uselessly stored away or disposed of by the parents.

SUMMARY OF THE INVENTION

In view of the above, and in accordance with the present invention, there is provided a toy game which, although it includes a game board, is sized to be readily transportable. The toy game is relatively small sized and has game pieces including at least one die to play the game. The game pieces, including the game board, are packaged in a manner preventing their loss or separation from the game.

To prevent the loss of the dice, the toy game of the present invention includes an enclosure housing a chamber having the die movably retained therein. The chamber in the enclosure has a transparent wall which allows visual access to the die. A manually operated mechanism is provided for impacting against and thereby randomly moving the die within the chamber to facilitate playing of the game.

In a preferred form of the invention, the game enclosure includes a cover which is pivotally connected to a base. The cover is movable between open and closed positions. In an open position, the cover is disposed generally upright relative to the base. In a closed position, the cover lies substantially parallel to the base. When the cover is closed, a cavity is defined between the base and the cover. The base preferably includes a floor portion surrounded by upstruck walls which position the cover in spaced relation from the floor portion.

A game board is removably accommodated within the cavity defined between the cover and the base when the cover is closed. In a preferred form, the game board is pivotally connected to either the cover or the base to prevent the game board from becoming separated from the enclosure. The game board includes a series of interconnected board segments which are foldable relative to each other to facilitate storage of the game board within the enclosure.

According to a preferred form of the invention, the cover of the enclosure is provided with an outer face and an inner face. The faces are joined together in a manner defining a cavity therebetween. A transparent housing is preferably arranged between the outer and inner faces of the cover to define a chamber which is at least partially surrounded by the cavity defined by the cover. The die for playing the game is movably retained within the chamber defined by the housing.

The manually operated device for randomly moving the die within the chamber includes a pivotal lever. The lever is provided with a face defining a movable wall portion of the chamber wherein the die is retained and against which the die gravitates when the game is played. The lever is mounted in the cavity defined by the cover and is manually driven from a first position to a second position.

The manually operated mechanism further includes an actuator for imparting movement to the lever. In a preferred form, the actuator is arranged for sliding movement relative to the cover along a path extending substantially perpendicular to the longitudinal axis of the lever.

Preferably, the manually operated mechanism is configured to provide an automatic snap-action return of the lever from its second position to its first position. In the preferred embodiment, the free end of the pivotable lever is designed as a cam follower which coacts with a cam to cause endwise displacement of the lever during its movement toward its second position. The endwise displacement of the lever permits it to return to its first position under the influence of a spring which imparts a snap-action return to the lever.

In addition to the above features, the game of the present invention may further include a device for tracking a player's score. In a preferred form, such a device can include a pair of rotatable wheels having indicia provided thereon for keeping track of the player's score.

Several associated markers may be used on the game board to play the game. To prevent the associated markers from becoming lost or separated during transportation of the game, a closable chamber may be provided in the cover. Such a chamber is provided in the cavity between the faces of the cover and includes a door for closing the chamber in a manner preventing the markers from becoming disassociated with the game.

The toy game of the present invention facilitates play by being relatively small sized and having the individual game pieces confined therewithin to prevent their separation or loss from the game. By forming the enclosure from plastic, the game is made durable and resistant to breakage while still being relatively lightweight.

Numerous other features and advantages of the present invention will become readily apparent from the following detailed description, the accompanying drawings, and the appended claims.

DETAILED DESCRIPTION OF A PREFERRED EMBODIMENT

Figure 1:
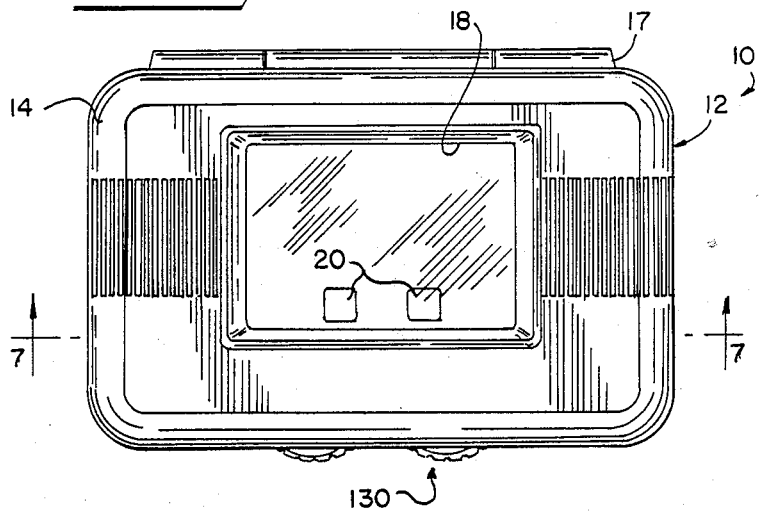
FIG. 1 is a plan view of a toy game according to the present invention.

While the present invention is susceptible of embodiment in various forms, there is shown in the drawings, and will hereinafter be described a presently preferred embodiment with the understanding that the present disclosure is to be considered as an exemplification of the invention and is not intended to limited the invention to the specific embodiment illustrated.

Figure 4:
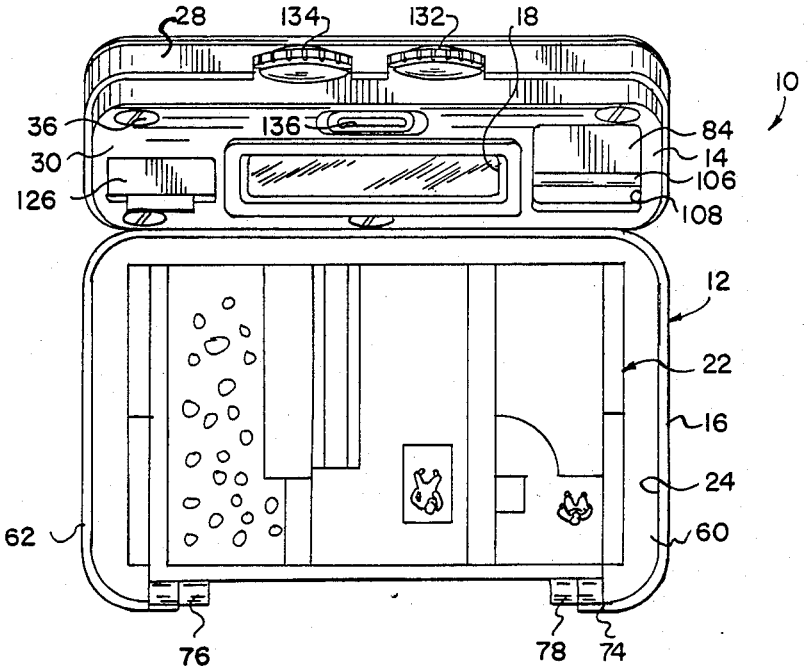
FIG. 4 is a plan view illustrating a cover for the toy game being arranged in an open position.

Referring now to the drawings, wherein like reference numerals indicate like parts throughout the several views, there is shown a pocket sized toy game 10. To promote transportability, game 10 is a self contained box-like assembly preferably comprising a two piece enclosure 12 including a cover 14 with an interconnected base 16. To facilitate playing of the game, enclosure 12 defines a chamber 18 having, on at least one side, a transparent wall and wherein at least one die 20 is movably retained. Arranged in combination with enclosure 12 is a foldable game board 22 (FIG. 4).

Figure 2:
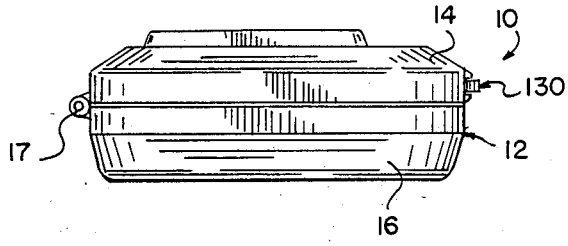
FIG. 2 is a side elevational view of the toy game illustrated in FIG. 1.
Figure 5:
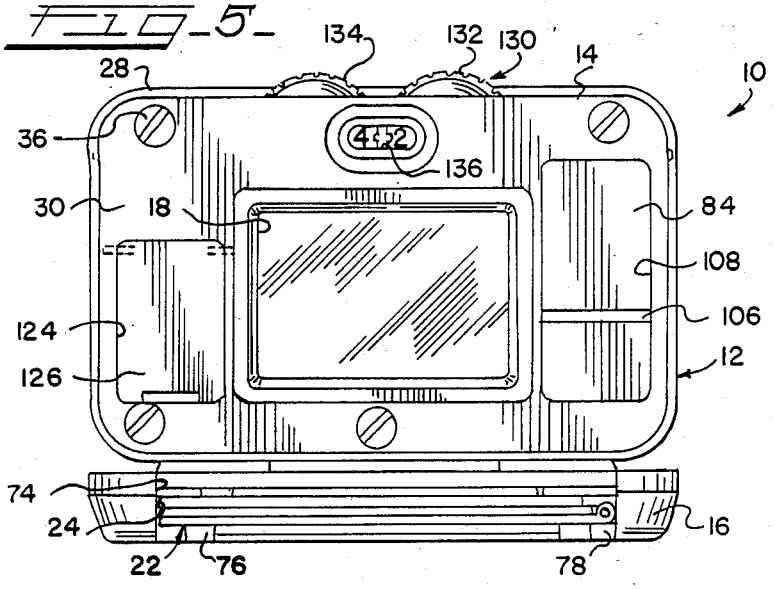
FIG. 5 is a front elevational view of the toy game with the cover in its open position.
Figure 8:
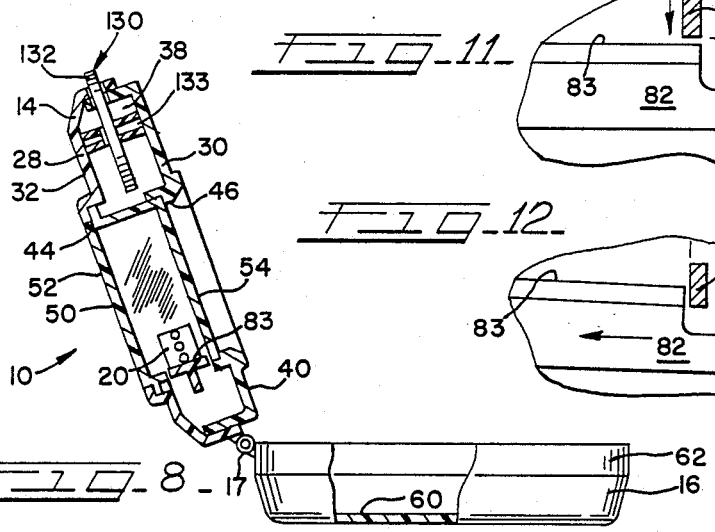
FIG. 8 is a partial sectional view taken along line 8—8 of FIG. 6.

As illustrated, cover 14 and base 16 are pivotally connected to each other. To effect such ends, a suitable hinge-like mechanism 17 is provided on an edge of the enclosure 12 to permit cover 14 to pivotally move relative to base 16 between open and closed positions. In a closed position, schematically illustrated in FIGS. 1 through 3, cover 14 is disposed substantially parallel to base 16 and defines a cavity 24 therebetween. When the cover 12 is closed, the foldable game board 22 is contained within cavity 24. In an open position, and as schematically illustrated in FIGS. 4, 5 and 8, cover 14 is disposed generally upright relative to the base 16.

Figure 7:
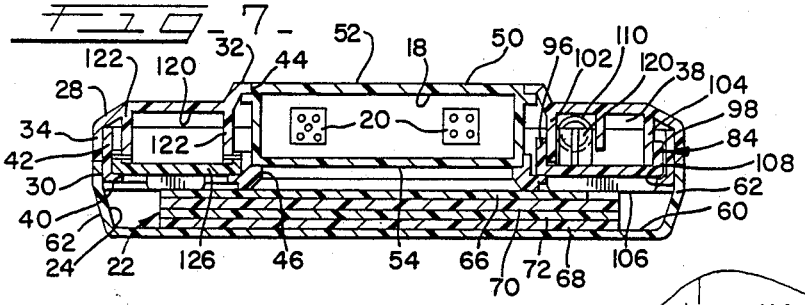
FIG. 7 is a sectional view taken along line 7—7 of FIG. 1.

Cover 14 is preferably formed as an assembly of individual plastic pieces including an outer piece 28 and an inner piece 30. As illustrated in FIGS. 7 and 8, outer piece 28 defines an outer face portion 32 and a skirt portion 34. The inner piece 30 of cover 14 is spaced from but joined to the outer piece 28 as by fasteners 36 (FIG. 4) and in a manner defining a cavity 38 (FIG. 8) therebetween. The inner piece 30 defines an inner face portion 40 for the cover 14 and includes a skirt portion 42 which snugly fits within the skirt portion 34 of the outer piece 28. In the illustrated embodiment, the outer and inner pieces 28 and 30, respectively, of cover 14 define substantially aligned openings 44 and 46, respectively.

In the preferred embodiment, chamber 18 is housed within cover 14 and is defined by an open sided transparent housing 50 which is secured to cover 14 and wherein dice 20 are movably retained. Housing 50 is at least partially surrounded by the cavity 38 defined between the outer and inner face portions 32 and 40, respectively, of cover 14. Housing 50 preferably includes at least two transparent side walls 52 and 54 which permit viewing of the dice 20 from opposite sides of the cover 14. Housing 50 is accommodated within and closes the openings 44 and 46 defined by the outer and inner pieces 28 and 30, respectively, of cover 14.

As illustrated in FIG. 7, base 16 is preferably formed of plastic and comprises a substantially planar floor portion 60 surrounded by upstruck wall portions 62. When cover 14 is closed, the free or terminal ends of wall portions 62 abut with the skirt portion 42 on cover 14 in a manner protecting the game board 22 arranged within cavity 24 against damage.

Figure 14:
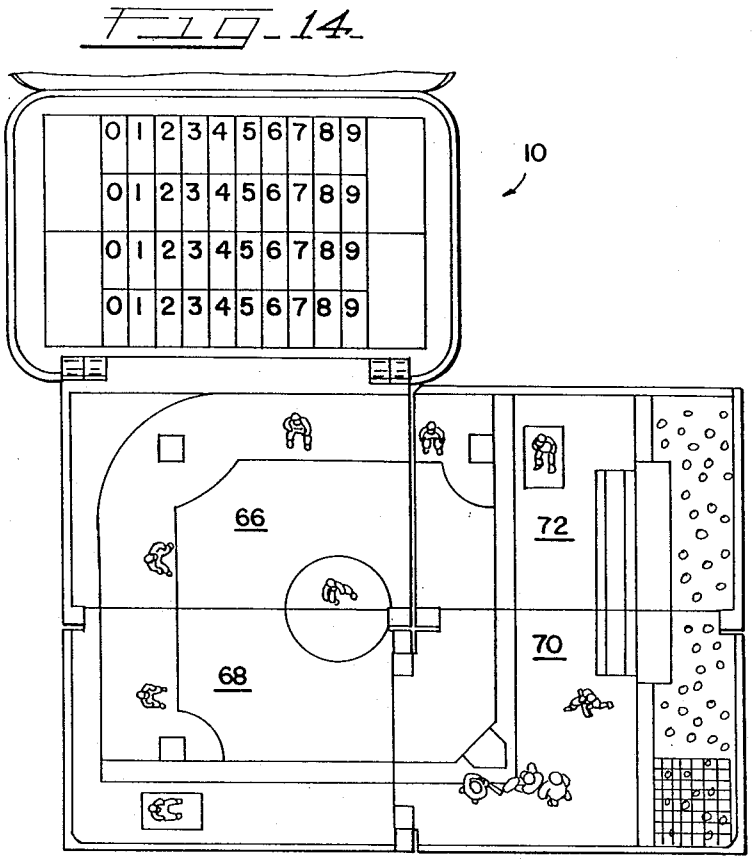
FIG. 14 is a view similar to FIG. 13 illustrating different segments of the board game of the present invention arranged in a playing condition.
Figure 13:
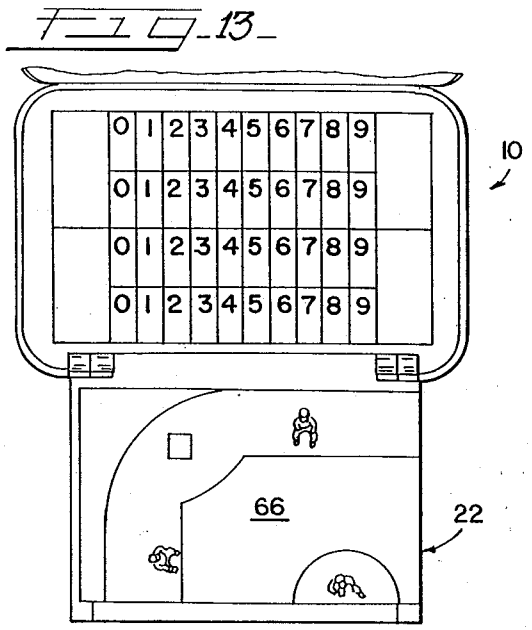
FIG. 13 is a fragmentary top plan view illustrating a game board interconnected to an enclosure of the present invention.

To promote integrity between component parts of the game, the game board 22 is preferably attached to the enclosure 12. As best viewed in FIGS. 7, 13 and 14, game board 22 is comprised of a series of interconnected and substantially similar planar board segments 66, 68, 70, 72. Each board segment represents one quadrant of the game board 22. Preferably, each board segment is pivotally connected to an adjacent board segment in a manner facilitating folding and stacking of the board segments upon each other for storage within cavity 24.

Figure 3:
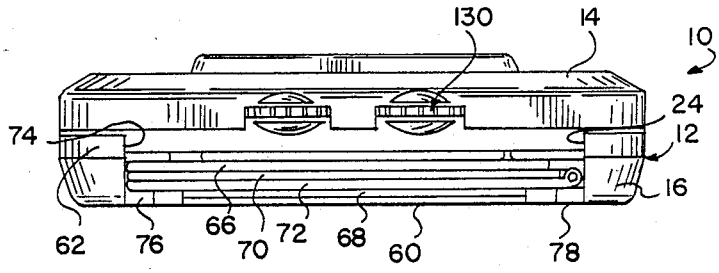
FIG. 3 is a front elevational view of the toy game of the present invention.

As best seen in FIGS. 3 and 5, one wall portion 62 of base 16 defines an opening 74 which extends toward the floor portion 60. Toward the lower end, and on opposing sides of opening 74, the base 16 and game board 22 are provided with suitable hinge-like structures 76 and 78 which pivotally interconnect one segment of the game board 22 to base 16.

To promote play, game 10 further includes a manually operated mechanism 80 for impacting against the dice 20 in a manner randomly moving the dice 20 within the chamber 18 of the enclosure 12. In the preferred embodiment, the manually operated mechanism 80 includes a pivotally mounted lever 82, an actuator 84 (FIG. 5) for moving the lever 82 between first and second positions, and a snap-action return apparatus 86 for automatically returning lever 82 to its first position. During its return motion, lever 82 impacts against the dice 20 in a manner randomly moving the dice within the chamber 18.

Figure 6:
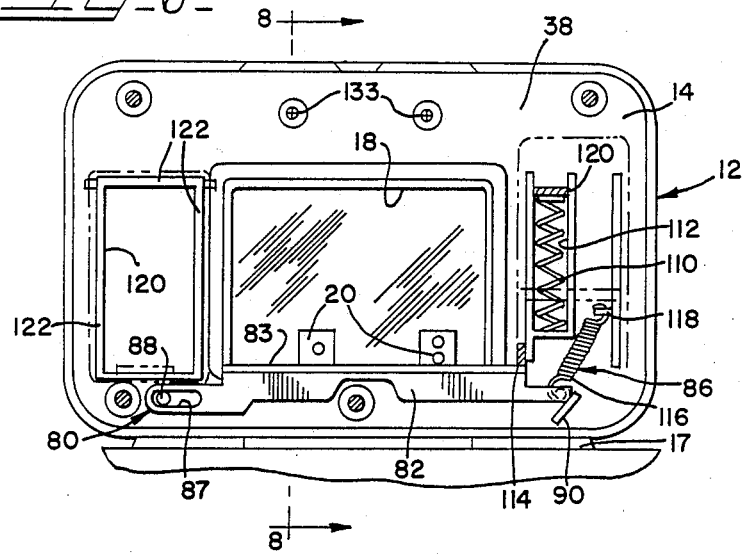
FIG. 6 is a front elevational view of the toy game with parts of the cover removed for purposes of clarity.

As illustrated in FIG. 6, lever 82 is pivotally mounted within cavity 38 of cover 14 beneath and adjacent to the open side of housing 50. The midsection of lever 82 has a T-shaped cross section including an upper face portion 83 which defines a movable wall portion of chamber 18. Lever 82 is so arranged in the cover 14 such that the dice 20 gravitate toward and rest upon upper face portion 83 of the lever 82 when the cover 14 is in an open position. As best seen in FIG. 6, one end of lever 82 is provided with an axially elongated slot 87 which coacts with a cross pin 88 projecting from the cover 14 in a manner pivotally securing lever 82 to cover 14.

Figure 11:
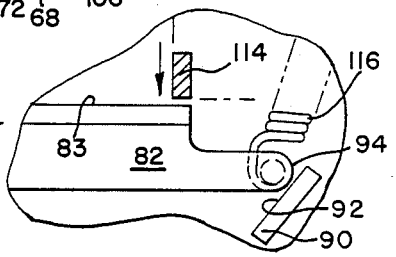
FIG. 11 is an enlarged fragmentary schematic view of a portion of a manually operated mechanism associated with the present inventions in a first position.
Figure 12:
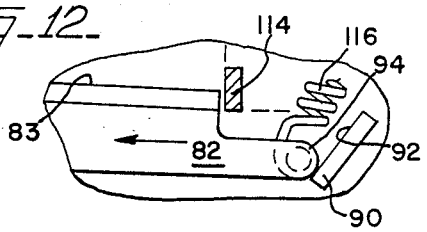
FIG. 12 is an enlarged fragmentary schematic view similar to FIG. 11 showing the manually operated mechanism in a second position.

Proximate the opposite end of lever 82 is a cam 90. In the preferred embodiment, cam 90 comprises a transverse web extending between the outer and inner pieces 28 and 30, respectively, of cover 14. As illustrated in FIGS. 11 and 12, cam 90 has a camming surface 92 which has a substantially straight line configuration extending at an acute angle to the longitudinal axis of lever 82. The free end of lever 82 includes a cam follower portion 94 which is adapted to move along the cam surface 92 as lever 82 moves between first and second positions.

Actuator 84 of mechanism 80 is adapted to coact with lever 82 in imparting movement to the dice 18. In its preferred form, actuator 84 is mounted for sliding movement along a generally straight line path extending substantially perpendicular to the longitudinal axis of lever 82. As illustrated in FIGS. 5 and 7, actuator 84 is captively mounted on one side of chamber 18 between the outer and inner pieces 28 and 30, respectively, of cover 14.

Figure 9:
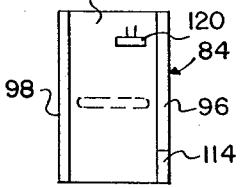
FIG. 9 is a rear view of an actuator of the present invention.
Figure 10:
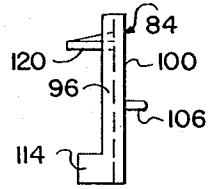
FIG. 10 is a side elevational view of the actuator of FIG. 9.

Particularly as illustrated in FIGS. 9 and 10, actuator 84 has spaced vertical arm portions 96 and 98 which extend along opposite sides of the actuator 84 and which are joined by a face portion 100. As seen in FIG. 7, arm portions 96 and 98 of actuator 84 project into cavity 38 of cover 14 and embrace a pair of vertical guides 102 and 104 which project from and are integrally formed with the outer piece 28 of cover 14. A handle portion 106, which extends from the face portion 100, projects through an opening 108 defined by the inner piece 30 of cover 14 in a manner permitting movement of the actuator 84 by a player.

To prevent inadvertent operation of the manually operated mechanism 80, actuator 84 is normally biased away from the lever 82. Several different devices could be used to accomplish such ends. In the preferred embodiment, and as best illustrated in FIG. 6, a resilient member 110 in the form of a compression spring, is provided to bias the actuator 84 away from lever 82 until a topside of actuator 84 abuts with a stopping surface defined in cavity 38 of cover 14. Spring 110 is captively received in a generally U-shaped spring chamber 112 which is formed as an integral part of cover 14. Turning again to FIGS. 7, 9 and 10, actuator 84 includes another projecting arm portion 120 extending into chamber 38 in a manner captively maintaining spring 110 between an underside of arm portion 120 and the lower end of spring chamber 112.

As illustrated in FIGS. 9 and 10, the lower end of actuator 84 is provided with an actuating finger 114 which, in the illustrated embodiment, is vertically movable into engagement with the upper face portion 83 of lever 82. Notably, the upper face portion 83 of lever 82 extends beneath the actuating finger 14 a relatively short distance when lever 82 is in its first position, schematically illustrated in FIG. 11. During movement of lever 82 to its second position, schematically represented in FIG. 12, cam 90 acts to impart endwise movement to lever 82 in a manner removing the upper face portion 83 of lever 82 from beneath the vertical path of actuating finger 114. The lever 82 is, therefore, not retained in its second position by the actuating finger 114.

The return apparatus 86 of the manually operated mechanism 80 is configured to provide an automatic snap-action return to the lever 82 from the second position in a manner impacting the dice 20 with random movement inside of the chamber 18 of cover 14. The return apparatus 86 includes a resilient member 116, in the form of a tension spring, to automatically return the lever to its first position under snap-action once the upper face 83 of lever 82 is no longer disposed beneath finger 114 of actuator 84. As illustrated in FIG. 6, one end of spring 116 is connected to the free end of the lever 82. The other end of the spring 116 is connected to a post 118 located in chamber 38 above and to one side of the free end of lever 82. By such construction, the spring 116 imparts both vertical and a horizontal components of movement during return movement of lever 82 to its first position.

Notably, and as seen in FIGS. 6 and 7, cover 14 further defines, on the opposite side of chamber 18, a chamber 120 for accommodating associated markers (not shown) which facilitate playing of the game 10. In the illustrated embodiment, chamber 120 is at least partially surrounded by cavity 38. Chamber 120 is defined by a plurality of interconnected walls 122 extending into cavity 38 preferably from the outer piece 28 of cover 14.

Turning to FIG. 5, the inner piece 30 of cover 14 defines an opening 124 which overlies chamber 120. Preferably, a hinged door 26 is arranged in combination with the inner piece 34 to close chamber 120 and, thereby, prevent the associated markers stored within the chamber 120 from inadvertently becoming separated from the game as by falling out of chamber 120.

The toy game of the present invention further includes a scoring apparatus 130 for tracking players' scores or points while playing the game. Such a scoring apparatus can take many forms. In the illustrated embodiment, the scoring apparatus 130 includes a pair of wheels 132 and 134 rotatably mounted on the cover 14.

A major portion of each wheel is rotatably mounted on a stub shaft 133 (FIGS. 6 and 8) extending between and supported by the outer and inner pieces 28 and 30, respectively, of cover 14. A radial segment of each wheel extends through suitable openings in the cover 14 beyond the enclosure 12 and is rotatable by a player. Each wheel is further provided with suitable indicia for keeping score. As seen in FIGS. 4 and 5, the inner piece 30 of cover 14 is provided with an elongated slot 136 through which the indicia on each wheel may be viewed in a manner tracking a player's score.

During transportation, cover 14 is normally maintained in a closed position with respect to base 16. The relatively small size of game 10 renders it easily transportable as in a pocket or purse of a player. Because the enclosure 12 is made from plastic, game 10 is durable and relatively light weight, with the game pieces and the game board protected against damage or loss during transportation.

To play the game, cover 14 is moved to an open position whereat it is disposed in substantially upright relation to the base 16. With cover 14 so disposed, the dice 20 gravitate toward and lie against the upper face portion 83 of lever 82. After opening the enclosure, the board game 22 may be removed from the base 16 and the board segments 66, 68, 70 and 72 are arranged in the manner illustrated in FIG. 14. Although illustrated as having a baseball playing field, it should be appreciated that the game board may illustrate any form of playing field suitable for the game being played.

To facilitate playing the game, the manually operated mechanism 80 is operated to randomly move the dice 20 within the chamber 18. Because walls 52 and 54 of housing 50 are transparent, players disposed on either side of the game may view the resultant movement of the dice 20.

To operate mechanism 80, actuator 84 is moved against the action of springs 110 and 116 in a manner moving the lever 82 from a first position to a second position. As a result of movement of actuator 84, the actuating finger 114 on the actuator 84 engages the upper face portion 83 of lever 82 in a manner urging lever 82 downwardly toward its second position.

As viewed in FIGS. 11 and 12, downward movement of the lever 82 causes the cam follower 94 on lever 82 to ride against the cam surface 92 in a manner causing endwise displacement of the lever 82. Once the upper face portion 83 of lever 82 clears the actuating finger 114, the lever 82 is forcibly returned with a snap-action under the influence of the return mechanism 86 to its first position thereby impacting against the dice 20 in a manner causing random movement thereof.

After random movement, the dice 20 gravitate and settle against the upper face portion 83 of lever 82 to provide a visual indication to a player concerning further play of the game. Thereafter, an associated marker is moved on the game board 22 accordingly. A player's score is maintained or tracked through movement of the wheels 132 and 134. The indicia on the wheels 132, 134 visible through the elongated slot 136, provide an indication of a player's score.

Having completed playing the game, the associated markers are stored within chamber 120 located in the cover 14 and the door 126 provided on cover 14 closes the chamber 120. As such, the associated markers are secured within the cover 14 in a manner preventing their loss or disassociation from the game. Because the dice 20 are retained within the chamber 18, they cannot be lost or disassociated from the game.

After folding them upon themselves, the various board segments 66, 68, 70, 72 comprising game board 22 are arranged within the base 16 in a stacked or folded relationship. Thereafter, the cover 14 will be closed with the game board 22 secured within cavity 24 of the enclosure 12 and the game 10 is ready for transportation. Because all the individual game pieces and the game board are enclosed within the enclosure 12, there is no concern over loss of various pieces of the game. Furthermore, the game is readily transportable and the enclosure 12 protects the game board 22 and playing pieces against damage.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the claims.

We claim:

1. A pocket sized toy game comprising:

a two piece enclosure including a cover pivotally interconnected to a base for movement between a closed position where said cover is disposed substantially parallel to said base and an open position whereat said cover is disposed generally upright relative to said base, said cover having an inner face joined to an outer face to define a cavity therebetween;

a transparent housing secured to said cover between said faces and defining a chamber at least partially surrounded by said cavity;

at least one die movably retained in said chamber; and manually operated means for randomly moving said die within said chamber, said manually operated means including a resiliently biased lever having a face defining a movable wall portion of said chamber and against which said die gravitates when said cover is arranged in said open position, said lever being mounted in the cavity defined by said cover for pivotal and endwise movement, said manually operated means further including an actuator selectively operated by a player for moving said lever a predetermined distance, said lever and said actuator defining cooperating means for providing a snap-action return to said lever after said lever has been moved said predetermined distance, the snap-action return of said lever propelling said die in a random movement to facilitate playing the game.

2. The pocket sized toy game according to claim 1 further including a multi-segmented foldable game board movably connected to said base and accommodated between said cover and said base when said cover is in a closed position.

3. The pocket sized toy game according to claim 1 wherein said actuator is arranged for sliding movement relative to said cover along a path extending substantially perpendicular to the longitudinal axis of said lever.

4. The pocket sized toy game according to claim 3 further including a resilient member for normally biasing said actuator away from said lever.

5. The pocket sized toy game according to claim 1 wherein said cover further defines an accessible chamber between said inner and outer faces for accommodating associated markers and which is closed by a door interconnected with said cover.

6. The pocket sized toy game according to claim 1 wherein said base includes a floor portion surrounded by upstruck walls which position said cover in spaced relation from said floor.

7. A pocket sized toy game comprising:

a walled enclosure including a cover pivotally interconnected to a base to define a cavity therebetween when said cover is in a closed position and lies substantially parallel to said base, one of said cover and said base housing a chamber bounded on at least one side by a transparent wall with at least one die movably retained in said chamber;

a game board pivotally connected to one of said cover and said base and removably accommodated within said cavity; and manually operated means arranged adjacent said chamber for impacting against and thereby randomly moving said die within said chamber for facilitating playing the game.

8. A pocket sized toy game comprising:

a two-piece enclosure including a cover interconnected to a base, said cover having an inner face joined to an outer face to define a cavity therebetween;

a transparent housing secured to said cover between said faces and defining a chamber at least partially surrounded by said cavity;

at least one die movably retained in said chamber;

manually operated means for randomly moving said die within said chamber, said manually operated means including a lever having a face defining a movable wall portion of said chamber and toward which said die gravitates, said lever being mounted in the cavity defined by said cover and is manually driven from a first position to a second position and is automatically returned to its first position in a manner propelling the die upward to impact random movement thereto; and a pair of rotatable wheels mounted on said cover, each wheel having indicia thereon for tracking a player's score.

9. The pocket sized toy game according to claim 8 further including a game board operatively associated therewith.

10. The pocket sized toy game according to claim 8 further including a game board pivotally connected to one of said cover and said base.

11. A pocket sized toy game comprising:

a walled enclosure defining a viewing chamber having two spaced generally planar surfaces and wherein at least one die is movably retained; and player operated means carried by said walled enclosure for randomly moving said die within said viewing chamber, said player operated means comprising a spring biased pivotally movable lever arranged beneath said chamber between said generally planar surfaces thereof, operative means selectively movable by a player for pivotally moving said lever along a first path of travel extending away from said chamber, cam means for engaging and moving said lever along a second path of travel opposed to said first path of travel in response to pivotal movement of said lever, and wherein said lever and said operative means define cooperating means for permitting the lever to rapidly return beneath said chamber after being moved a predetermined distance along said two paths of travel, the rapid return of said lever beneath said chamber effecting random movement of the die within said viewing chamber to facilitate playing the game.

12. The pocket sized toy game according to claim 11 further including a game board operatively associated therewith.

13. The pocket sized toy game according to claim 11, wherein said enclosure includes a cover pivotally interconnected to a base to define a cavity therebetween when said cover is in a closed position and lies substantially parallel to said base.

14. The pocket sized toy game according to claim 11 further including scoring means carried by said enclosure for tracking a player's score.

* * * * *